United States Patent [19]

Castaldo

[11] 4,376,935

[45] Mar. 15, 1983

[54] HANDBAG UTILIZING AUTOMATICALLY FUNCTIONING ILLUMINATION AND ALARM DEVICES

[76] Inventor: Stanley C. Castaldo, 704 N. Lake Pleasant Rd., Apopka, Fla. 32703

[21] Appl. No.: 291,273

[22] Filed: Aug. 10, 1981

[51] Int. Cl.[3] ..... G08B 13/14

[52] U.S. Cl. ..... 340/571; 340/517; 340/547; 340/573; 200/61.58 R

[58] Field of Search ..... 340/517, 545, 546, 547, 340/568, 571, 573, 574; 200/61.58 R, 61.45 M

[56] References Cited

U.S. PATENT DOCUMENTS

| | | | |
|---|---|---|---|
| 548,887 | 10/1895 | Murphy | 340/571 |
| 1,234,847 | 7/1917 | Woitas | 340/571 |
| 3,239,658 | 3/1966 | Castaldo | 200/61.58 R |
| 4,117,468 | 9/1978 | Vasquez | 340/571 |

*Primary Examiner*—John W. Caldwell, Sr.
*Assistant Examiner*—Donnie L. Crosland
*Attorney, Agent, or Firm*—Julian C. Renfro

[57] ABSTRACT

An electrical arrangement for a handbag including a switch unit having at least one electrical terminal on its exterior, a magnetically resposive switch in its interior connected to the terminal, and a battery in the handbag connected to the terminal and to the magnetically responsive switch. The terminal is adapted to receive either an illumination device or an alarm device at the option of the handbag owner. A magnet is utilized in conjunction with my novel switch unit, with the switch unit being mounted on one interior wall of the handbag, and the magnet being mounted on another interior wall of the handbag in a position opposite, and in substantial alignment with, the switch unit. The magnet is supportable in at least two different positions on its mounting such that when in a first position it can interact with the magnetically responsive switch as the handbag is opened or closed, thus causing the illumination of a bulb or sounding of the alarm as the handbag is opened. However, when the handbag owner has moved the magnet to a second position, the magnet does not bring about a switching function as the handbag is opened, thus enabling the handbag owner to utilize an alarm circuit that will sound if the unattended bag is lifted off a surface upon which it has been resting, irrespective of the bag being open or closed. A number of different illumination circuits and alarm circuits are available at the option of the owner.

19 Claims, 8 Drawing Figures

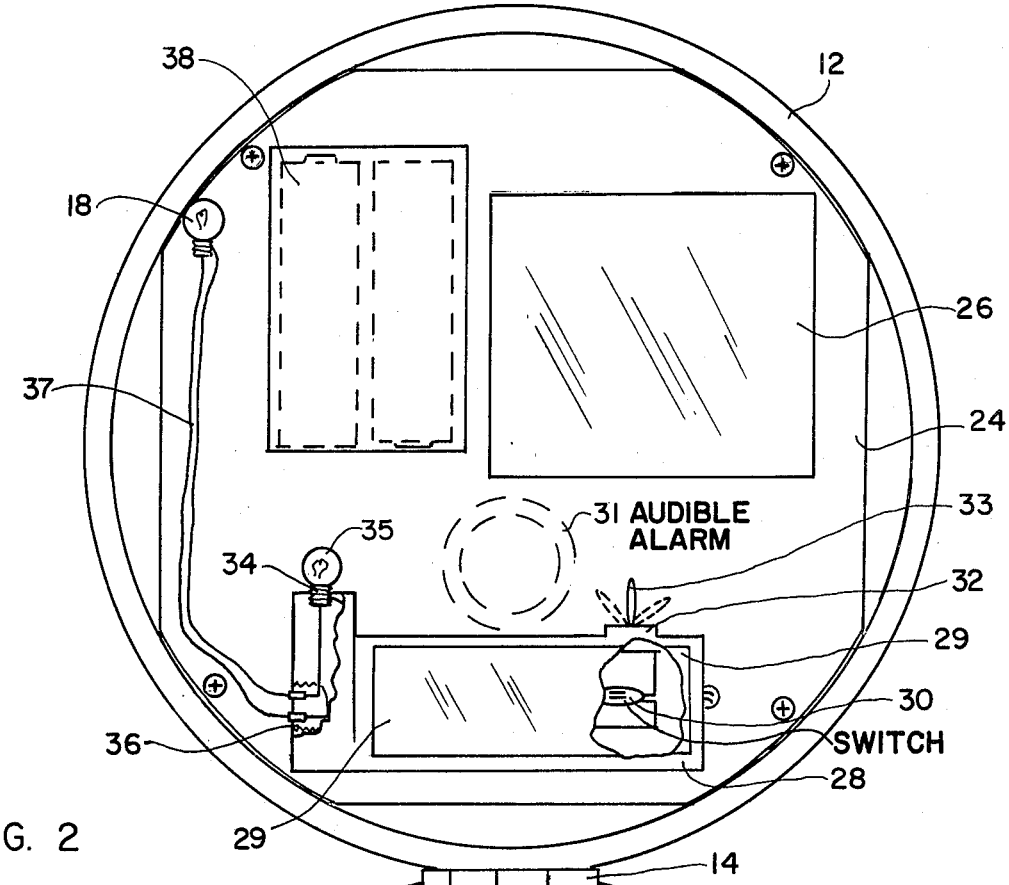
FIG. 2
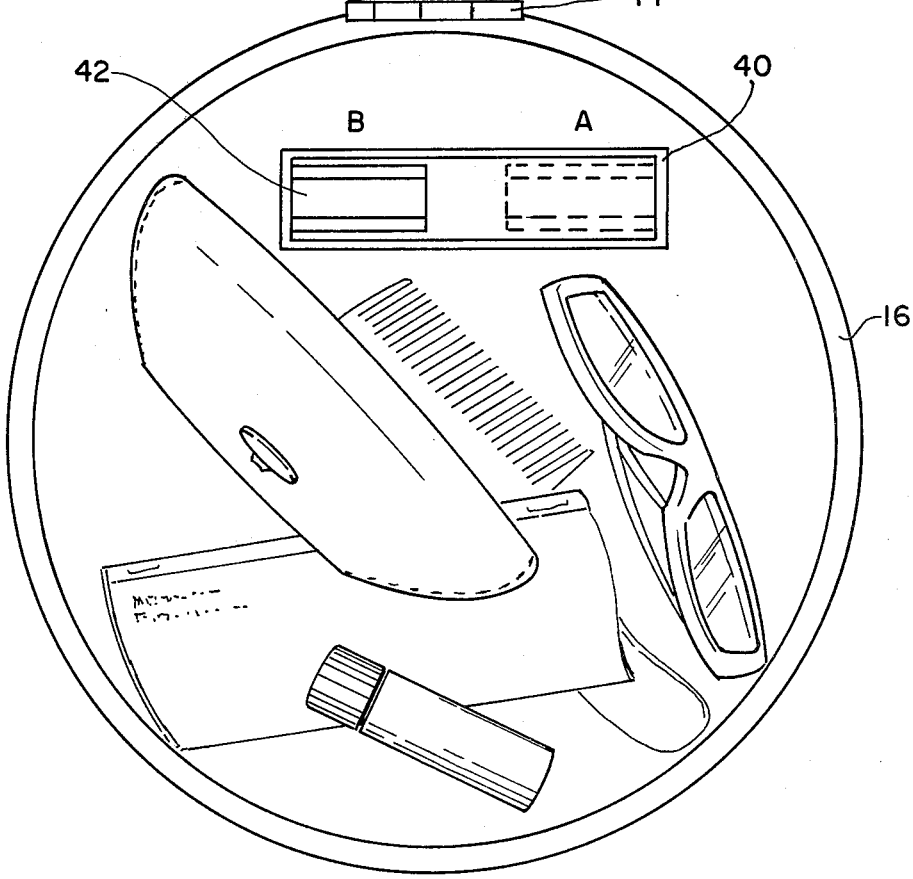

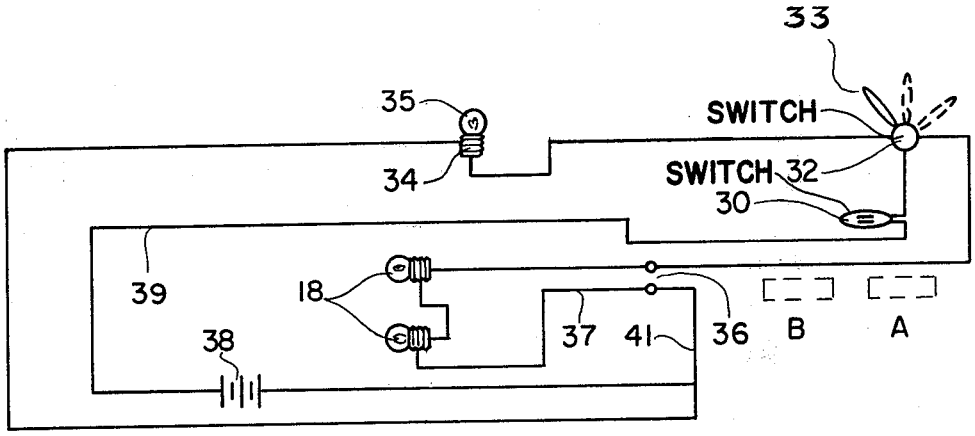
FIG. 3
FIG. 4b
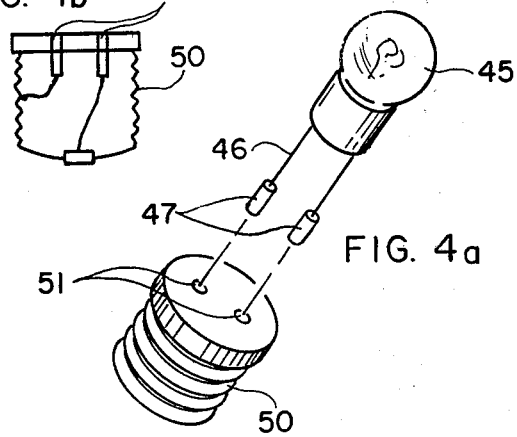
FIG. 4a
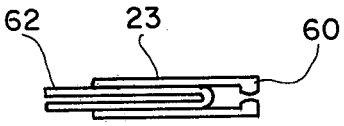
FIG. 6a
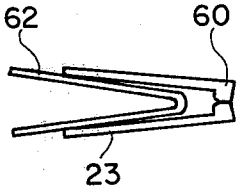
FIG. 6b
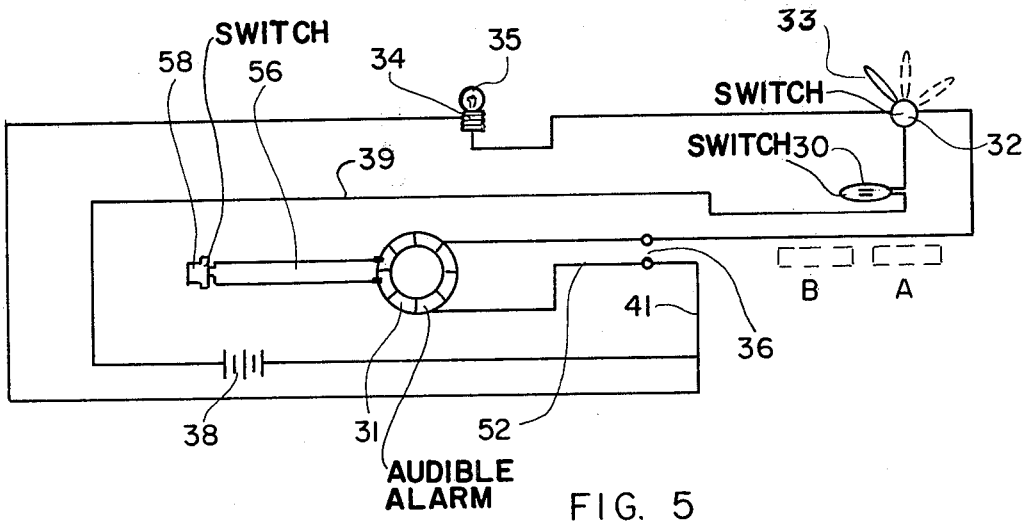
FIG. 5

HANDBAG UTILIZING AUTOMATICALLY FUNCTIONING ILLUMINATION AND ALARM DEVICES

BACKGROUND OF THE INVENTION

The present invention is related to those teachings concerned with providing illumination for the interior of a handbag, such as a lady's purse or pocketbook, or alternatively, may be utilized with handbags of the type including valises, makeup kits, briefcases and the like, for illuminating the interior of same.

The prior art is replete with patents showing the use of various switch means for causing a light on the interior of the handbag or purse to come on, and these include manually operated means as well as automatically functioning apparatus. In the latter type of device, a reed switch may be utilized, with a magnet being disposed on the interior of the handbag at a substantially opposite location to the reed switch such that when by the opening of the handbag, the magnet is caused to move away from the reed switch, a circuit is completed causing the light to come on, whereas a closing of the bag causes the magnet to be moved to a position that is in substantial juxtaposition with the reed switch, with this causing the circuit to the illumination means to be broken. My U.S. Pat. No. 3,800,134 is exemplary of this type of device.

Other known devices have included lighting arrangements for handbags in which manipulation of the clasp of the bag enables the user to selectively turn on and off the illumination means, and yet other arrangements have of course included the use of a flashlight incorporated in the handbag that can be used exteriorly.

It was to overcome some of the limitations of these prior art devices that the present invention was made.

RELATIONSHIP TO PREVIOUS INVENTIONS

This invention may be regarded as an improvement over certain of my earlier inventions, including my U.S. Pat. Nos. 3,239,658 and 3,800,134.

SUMMARY OF THE INVENTION

The electrical arrangement for a purse or handbag in accordance with this invention may utilize an electrical theft alarm capable of providing an intense audible signal when current passes therethrough. A suitable control switch is electrically connected to the theft alarm, and a battery is connected to the alarm and to the switch so as to supply electric current through the alarm when the switch has been moved to its closed position. The theft alarm is preferably equipped with an activation switch which in one position serves to deactivate the alarm. However, upon the activation switch being moved to a closed position as a result of the purse being disturbed, a flow of current takes place through the alarm so as to cause the sounding thereof. A suitable switch arrangement enables the user to disable the alarm when she is about to use the purse or handbag herself.

In accordance with one theft alarm arrangement, an activation switch is disposed on the underside of the purse and functions to cause the sounding of the alarm when the purse is lifted. Another embodiment involves the activation switch being positioned so as to bring about a flow of current through the alarm and thus the sounding of the alarm when the purse or handbag is opened, such as by an unauthorized person.

A preferred embodiment of my invention utilizes a magnetically responsive control switch disposed in a switch unit that can be conveniently mounted on an interior wall of a purse or handbag. A magnet disposed in a suitable mounting arrangement is installed on the interior wall of the handbag opposite from the switch unit, with the arrangement being such that when the magnet is in a first position, it causes the control switch to open at such time as the user closes her purse, thus eliminating any drain on the battery. Thereafter, upon the purse being opened, either a light bulb disposed in the interior of the bag is caused to turn on and illuminate the interior of the bag, or else, if a different electrical connection has previously been made, the theft alarm is caused to sound.

If, however, the magnet has been placed by the bag owner in a second position, in which it is out of alignment with the control switch, the opening and closing of the purse no longer has any effect upon the condition of the control switch. This makes it possible for the electrical components to remain energized when a certain type of theft alarm is about to be used.

My switch unit is preferably configured with a terminal that quickly enables the user to connect and activate the theft alarm if she is about to set her purse down in a public place. Presuming of course she has preset the magnet to the active position, the alarm will sound if an unauthorized person opens the handbag.

In the preferred instance, my novel switch unit is configured to have a pair of electrical terminals, with one of these normally receiving the bulb to illuminate the interior of the handbag, and the other terminal arranged to receive either one or more additional bulbs that will provide illumination to guide the lady's footsteps at night, or else enable the connection of a suitable type of theft alarm. As will be obvious, the user can have a pair of illumination sources, or she can plug in one or two theft alarms, or perhaps most ideally, she can have one illumination source and one theft alarm.

So that an unnecessary disturbance will not be created if no theft is involved, I provide a switch available to the user of the purse or handbag so that she can disable the alarm or alarms being used in the event she later wishes to use the handbag herself.

As should now be obvious, it is a primary object of my invention to provide a novel switch unit for a handbag so that a desired type of illumination and a desired type of alarm arrangement can be readily selected, as will be most suitable in a given instance.

It is another object of my invention to provide a novel animal type handbag wherein the pair of light bulbs can be utilized thereon to simulate the eyes of the animal, which eyes can be caused by the purse owner to illuminate when desired.

It is yet another object of my invention to provide a handbag having a plurality of illumination circuits such that either interior illumination or exterior illumination for the handbag can be provided, both of which can be brought about either automatically or manually.

It is still another object of my invention to provide a switching arrangement responsible in one instance for turning on the illumination means of the handbag when the bag is opened, yet by virtue of its versatility, such switching means can make it possible for a theft alarm to be energized whether or not the bag is in an open position.

It is yet still another object of my invention to provide a switching arrangement for a handbag making it possible for a multiplicity of selected switching operations to be brought about automatically, as well as certain other switching operations accomplished manually by the user.

It is a still further object of my invention to provide additional versatility to a reed switch arrangement, such that the reed switch is effective to interrupt the flow through an associated electrical device only if such is deemed by the owner of the handbag to be appropriate for the particular circumstance.

BRIEF DESCRIPTION OF THE DRAWINGS

FIG. 2 is a view to a larger scale of the interior of a handbag such as illustrated in FIG. 1, in which the head portion of the animal is equipped with my novel switch unit and electrical components used therewith, and the body portion, to which the head is hingedly attached, is available for receiving toilet articles, sun glasses, comb and the like;

FIG. 3 is an electrical schematic of an embodiment of my invention in which a plurality of illumination sources are utilized, and a magnetically responsive control switch can be utilized in conjunction with a magnet having two principal positions, with the magnet in only one such position having an effect upon the control switch;

FIGS. 4*a* and 4*b* are related figures concerned with the details of certain components usable in one of the electrical devices of the schematic according to FIG. 3;

FIG. 5 is a schematic generally along the lines of FIG. 3, but showing the use of a theft alarm connected to one of the terminals of the switch units, which theft alarm is equipped with an activation switch; and FIGS. 6*a* and 6*b* reveal an activation switch of the type that may be utilized to bring about the sounding of the theft alarm if an unauthorized person lifts the handbag so equipped.

DETAILED DESCRIPTION

Figure 1:
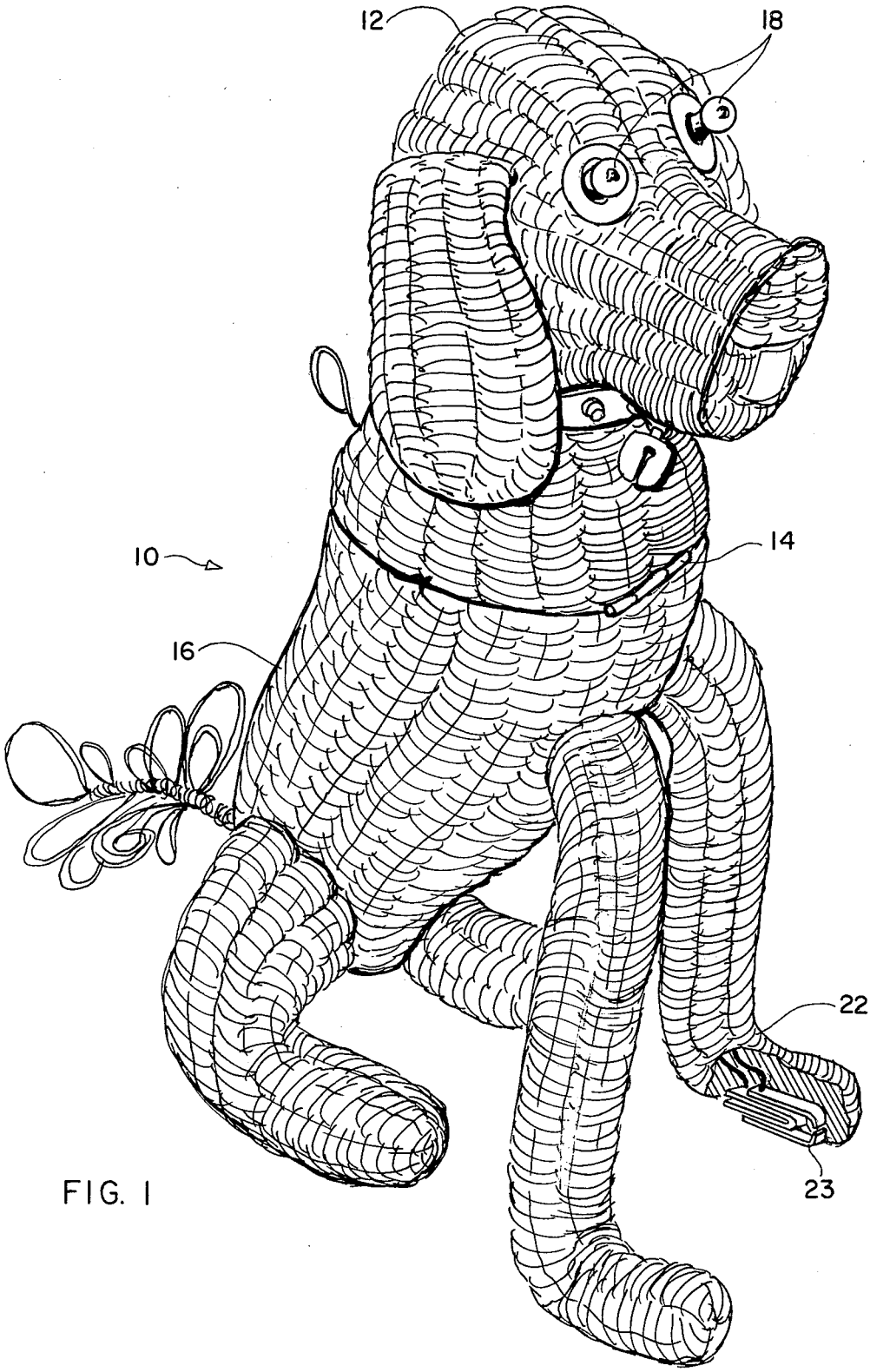
FIG. 1 is a view of an embodiment of my invention in which certain illumination means and theft alarm means are incorporated in a purse or handbag created in the configuration of an animal, such as a dog.

Turning to FIG. 1, it will there be seen that I have shown a purse or handbag 10 in the configuration of an animal such as a dog. The head 12 is mounted on a hinge 14 located in the forward neck portion of the animal so that the head can be pivoted forward to make the body portion 16 of the animal available for carrying toilet articles, keys, money, comb, sunglasses and the like. It is obvious that this type of handbag would be of particular interest to a child or young adult, and the young person's enjoyment of this purse is heightened by the fact that the eyes 18 can be caused to light up. My invention, however, is applicable to handbags and purses generally, and is not in any way limited to a purse or handbag of animal configuration.

In addition to teaching the use of selectively operable external illumination means such as eyes that can be turned on, internal illumination can be utilized such that retrieval of an item from the interior of the handbag can be facilitated.

Another aspect of this invention, discussed at fuller length hereinafter, involves a theft alarm arrangement that will sound at such time as the bag is disturbed by an unauthorized person. The activation switch associated with one such alarm arrangement can be incorporated for example in the foot 22 of the dog.

Turning to FIG. 2, it will be noted that I have pivoted the head portion 12 forwardly about the hinge point 14 so as to make available to body portion 16 of the dog such that items can be placed in the bag, or retrieved therefrom. Disposed in the head portion is a mounting plate 24 upon which a mirror 26 may be secured. Also located on the mounting plate 24 is a switch unit 28 that contains a reed switch 30, and a switch 32 equipped with a switching lever 33.

The reed switch is magnetically responsive, and may be substantially identical to the reed switch shown and described in my U.S. Pat. No. 3,800,134, which issued Mar. 26, 1974. The teachings of that patent are herein incorporated by reference.

The reed switch 30 may hereinafter be referred to as a control switch, and the switch 32 may hereinafter be referred to as a selector switch or a multiposition switch. When the lever 33 of switch 32 is in the vertical position shown in full lines in FIG. 2, no current is flowing through the switch whereas circuits to selected illumination means and theft alarm means may be energized when the switching lever is moved to the left hand position or to the right hand position shown in dotted lines in FIG. 2.

The switch unit 28 may be made of plastic, and may be closely along the lines of the switch unit shown and described in my U.S. Pat. No. 3,800,134. However, the switch unit 28 of the instant invention has additional features, as will be described shortly.

One of the important modifications made with respect to the earlier switch unit is the provision of a receptacle 34 on the upper part of the switch unit 28. This receptacle is preferably of a screw base type, arranged to receive therein a screw base bulb 35, such as an incandescent bulb. However, I am not to be limited to an incandescent bulb, for other illumination means could be used.

On the front of the switch unit 28 is a mirror 29. The arrangement is such that the illumination provided by bulb 35 is of assistance to the purse owner in locating items in the bottom of the bag. Sufficient illumination is provided that the user can make use of either mirror 26 or mirror 29 in applying lipstick, makeup, or the like.

Another important modification represented by the switch unit 28 is the provision therein of an electrical receptacle or terminal 36. This receptacle is equipped with a spaced pair of holes, into which a pair of male connectors may be received. I prefer for a 3/16" spacing to be utilized for the male and female components, but obviously I am not to be limited to this spacing.

In the arrangement illustrated in FIG. 2, the ends of the pair of leads 37 have been shown residing in the pair of apertures of the terminal or receptacle 36. These leads 37 connect to bulbs 18 representing the eyes of the dog shown in FIG. 1. Behind the mounting plate 24 are one, two, or more dry cell batteries 38 used to supply electricity to the various electrical components used in my handbag. The connection of the switch unit to the batteries is accomplished by wires emerging from the right hand end of unit 28, which go through a small hole provided for that purpose in mounting plate 24, and then connect to the power supply 38. Also located behind mounting plate 24, or disposed on the rear side thereof, is a theft alarm device 31. The circuits that may be utilized in the interconnecting of the various electrical components will be described hereinafter.

As described hereinabove and in my earlier patents, a reed switch is particularly useful in providing a relatively inexpensive control switch function for a purse or handbag, so that for example illumination will be automatically provided when needed, but the battery power not depleted unnecessarily by the illumination means remaining on when the purse or handbag has been closed. The reed switch may be regarded as a normally closed device, that is, it normally completes the circuit between a battery and a bulb or the theft alarm, but when a permanent magnet is brought near, the circuit is electrically broken such that the bulb will go off.

My earlier patents used a permanent magnet that was always in a consistent relationship to its respective reed switch. For example, in a handbag having a snap top, the permanent magnet was placed on one side of the opening, and the reed switch was placed on the opposite side, always in careful alignment with the magnet. In this way, each time the handbag was closed, the reed switch and the magnet was caused to closely approach each other, and the circuit associated with the illumination means was caused by switch-magnet interaction to be broken. Although that type of arrangement was satisfactory in many regards, in other instances it was not desirable to break the circuit of the handbag when the bag was closed.

In as much as it is one of the goals of this invention to provide a theft alarm arrangement that can remain activated even when the bag is closed, I have evolved in accordance with this arrangement, a permanent magnet having at least two positions, that in one position can still cause the circuit to be broken as a direct result of closure of the bag. However, so that certain circuits could stay activated, the permanent magnet can selectively be moved to a so called inactive position such that at no time does it closely approach the sensitive part of the reed switch.

Even though this arrangement will meet the aforementioned goal of permitting an electrical circuit to remain active even when the bag has been closed, it may still be desirable to enable the purse owner to turn off such additional circuit, or even be able to switch between various circuits that have been provided in the handbag. To that end I provide the previously mentioned selector switch 32 for the convenience of the purse owner, which switch has two active positions, as well as a neutral position in which all circuits are disabled.

As seen in FIG. 2, I have provided a plate 40 on the side of the hinge 14 opposite from the electrical unit 28, and in carefully spaced relation thereto. This plate preferably has a form of clasp or shoulder running along each of its long edges, with a permanent magnet 42 retained between these edges. In this embodiment, the magnet is held in such a way that it can be selectively moved between position A in which it is substantially aligned with the sensitive part of the reed switch 30, and a position B in which it is sufficiently out of alignment with the reed switch as to have no effect on the associated circuit at such time as the handbag has been closed. The magnet can be slid relatively easily, but then remains in the selected position. The utility of this slidable magnet arrangement is about to be described.

Turning to FIG. 3, I have shown approximately the same subject matter as in the mid part of FIG. 2, but in this instance I have shown the significant electrical details with greater particularity. It will be noted that the dry cell battery 38 is disposed to supply current via lead 39 and reed switch 30 to the three position switch 32, with the lever of 33 of this switch, when in the right hand position, causing current to flow to the pair of bulbs representing the eyes 18 of the dog. The current leaving these bulbs then returns through a lead 41 to the other side of the battery. The reed switch 30 completes the circuit as long as the permanent magnet 42 is not close to the reed switch.

The lever 33 of the selector switch 32, when in the centered position, turns off all of the circuits illustrated in this figure, but when the lever is in the left hand position, it causes the flow of current through the bulb 35 associated with the providing of illumination to the interior of the handbag.

As should now be obvious, when the user has moved the permanent magnet to position A and the lever of the three position switch to the left hand position, the bulb 35 is caused to illuminate the interior of the handbag, including the mirror 29, at such time as the handbag has been opened, and the magnet thus caused to move away from the reed switch. Then, when the handbag has been reclosed, the magnet is caused to open the circuit associated with the reed switch, which in this particular instance serves to turn off the illumination means in the interior of the handbag, thus avoiding unnecessary battery depletion.

Should the purse owner be out at night and desire to have her steps illuminated, she can move the lever of the three position switch 32 to the right hand position, at which time the eyes 18 illuminate and provide a lighted pathway for her as long as the magnet is away from the reed switch.

Now summarizing, with the magnet 42 in its operative position and the switch lever 33 in its left hand position, the circuit involving the reed switch is broken by the approach of the permanent magnet. Accordingly, the interior bulb 35 is on when the head 12 is opened, but off when the head is closed. As is obvious, this arrangement provides the purse owner with a suitable amount of illumination so that she can retrieve a desired item from her purse or use an illuminated mirror each time she opens the purse.

In accordance with a second condition, the magnet 42 remains in active position A, but the switch lever 33 is turned to the right hand position. In this instance, the eyes 18 of the dog are activated instead of the interior bulb. In the particular instance at hand, the eyes are on when the head is opened and off when the head is closed. As is apparent, this arrangement can be used when the purse owner needs some illumination to guide her footsteps at night.

In the third example, the slider magnet has been moved to position B in which it no longer acts upon the reed switch. When the switch lever is in the left hand position, the light bulb 35 is on, and the switch must be moved to its center or neutral position in order to turn it off.

Lastly, with the magnet remaining in position B in which the control switch 30 is not activated, the switch lever 33 can be turned to the right hand position. In this instance the eyes of the dog are turned on, and they are turned off by the movement of the switch lever 33 to the center or neutral position.

Although I have thus far described this invention primarily with regard to its various forms of illumination means, it is to be understood that my invention readily lends itself to the use of one or more theft alarms. In such instance the pair of leads of the alarm are plugged into the pair of orifices of receptacle 36 shown at the left side of the electrical unit 28 in FIG. 2. In use, a continuous supply of current is furnished to the alarm so that a shrill audio noise or signal can be emitted if the bag is disturbed. In one form, the alarm would sound if the magnet 42 is in position A and the bag is opened by an unauthorized person, but in another form, a switch 23 could be utilized under the foot 22 of the animal such that lifting the bag sets off the alarm.

Turning to FIG. 4*a*, it will be noted that instead of showing the interior bulb 35 on a conventional screw base, I have instead shown an incandescent bulb 45 having a pair of leads 46 extending therefrom. Terminal ends 47 are provided on the ends of leads 46.

The occasion for this design is that in accordance with this invention and as illustrated in FIG. 4*b*, I provide a screw base receptacle 50 of the type that will screw into the lamp socket 34 after the bulb 35 has been removed. The screw base receptacle 50 is equipped with a pair of small holes or apertures 51 into which the ends of lead 46 can be inserted, in order that appropriate electrical contact will be made. As can readily be appreciated, the leads 46 can be any practical length, which enables the owner of the purse to utilize the bulb 45 as an illumination source either inside the handbag or outside. The use of my theft alarm arrangements can either be in connection with terminal 36, or else with terminal 34 while using screw base electrical receptacle 50. As is obvious, the terminal ends 47 can be assembled into a suitable plug of non-conductive material, that will maintain the terminal ends at the spacing selected for receptacles 36 and 50, such that it can be readily used with either.

Turning to FIG. 5, it will be noted that I have shown a diagram of my device closely resembling the circuit of FIG. 3, except that in this instance, I have shown the theft alarm 31 installed in an electrically active position. The alarm, which may be of a suitable type manufactured by any commercial theft alarm company, is modified to be equipped with a pair of leads 52, which leads are readily adaptable to be inserted into the two orifices of terminal 36 in order to make electrical contact. This of course necessitates the previous removal of the leads associated with the eyes 18 from terminal 36.

In its simplest application, the alarm 31 would sound if the owner has moved the switch lever 33 to the right hand position; has placed the permanent magnet in position A, the active position of the magnet; and thereafter the purse is opened. Quite obviously, under these circumstances the alarm would sound whether the purse owner or an unauthorized person opened the purse. To this end, I provide a means for disabling the alarm when the owner is about to open her purse. A conventional theft alarm would be modified to be equipped with an additional pair of terminals into which the leads 56 of switch means 58 may be inserted. This switch, which may be referred to as an activation switch, would be disposed at some inconspicious external part of the bag. By depressing the switch, the burglar alarm is disabled, thus enabling the purse owner to open her purse without startling other persons who may be nearby, or giving away the fact that her purse utilizes an alarm system.

Continuing with FIG. 5, this arrangement may also be used in connection with the theft alarm arrangement mentioned much earlier in connection with foot 22 of the dog; see FIG. 1. The activation switch 23 in that instance may be regarded as residing electrically in the same position as switch 58 in FIG. 5, and by way of example, FIG. 6*a* reveals that switch 23 can entail a pair of contacts 60 caused to be separated such that the circuit is not complete. A spring 62 such as of teflon or any other suitable non-conductive material can be utilized for supporting the contacts, and the weight of the handbag on the foot 22 of the dog is sufficient to keep the points of the switch 23 separated. When, however, an unauthorized person lifts the handbag, the teflon spring 62 snaps the electrical points 60 together such that the circuit is completed and the alarm 31 is caused to sound. FIG. 6*b* shows the contacts of the activation switch in the condition in which they touch and complete the alarm circuit.

It is important to keep in mind that when the magnet is in position "A", the opening of the bag turns on everything whereas closing the bag turns off everything. Therefore, when the alarm is being used to warn of an unauthorized person opening the bag, the magnet is kept in active position A, and the lever 33 of selector switch 32 is utilized in its right hand position.

When the magnet is in position "B", the electrical functions are brought about without regard to the opening or closing of the bag. When using the motion sensitive foot switch, the lever 33 of switch 32 is in its right hand position, when the arrangement of FIG. 5 is being used.

It is to be noted that my theft alarm arrangement is characterized by its flexibility, and by way of example I can utilize the lamp base socket 34 for the alarm merely by using the lamp base adapter 50 previously described. If the activation switch 23 is being used, the switch lever 33 would be in the left hand position in order that receptacle 34 will be energized, and the magnet 42 is maintained in its inactive position B.

By way of summation it should be pointed out that one manner of use of my invention can entail a bulb utilized in lamp socket 34, and one or more bulbs connected to operate out of receptacle 36. Typically the magnet would be utilized in position A such that the opening of the bag would bring about the illumination of one or the other of the bulbs.

Another mode of use of my invention can entail a bulb being utilized in socket 34 but the open bag alarm being utilized in connection with terminal 36 instead of the eyes 18 being utilized.

Yet another mode of operation can entail the foot actuated alarm utilized in connection with socket 34 and the eyes illuminated from terminal 36.

Still another mode of operation can be a pair of theft alarms, with the foot actuated alarm connected to terminal 34, and the open bag alarm utilized in terminal 36.

Other arrangements within the scope of this invention will be apparent to those skilled in the art.

I claim:

1. An electrical arrangement for a purse or handbag, comprising a switch unit having at least one electrical terminal on its exterior, and a magnetically operable switch in its interior connected to said electrical terminal; and a magnet used in conjunction with said switch unit, means for mounting said switch unit on one wall of the handbag, and means for mounting said magnet on another wall of the handbag in a position opposite, and in substantial alignment with, said switch unit; and an electrical source connected to said magnetically operable switch and to said electrical terminal such that when said switch is in a closed condition, current will flow from said source to an electrical device connected to said electrical terminal, said magnet being supportable in at least two different positions on said magnet mounting means, such that when in a first position, it can interact with said magnetically operable switch as the handbag is opened or closed, and when in a second position on said magnet mounting means, it is disposed sufficiently far away from said magnetically operable switch as not to interact therewith as the handbag is opened or closed.

2. The electrical arrangement as defined in claim 1 in which said electrical terminal is designed to receive a bulb, said bulb being caused to illuminate as the handbag is opened, with the bulb being extinguished when the user closes the bag.

3. The electrical unit as defined in claim 1 in which said electrical terminal is designed to receive a bulb, said bulb, when said magnet is in a first position on its mounting means, causing said bulb to illuminate as the handbag is opened, and to extinguish when the handbag is again closed.

4. The electrical unit as defined in claim 3 in which said bulb, when said magnet is in said second position, is caused to illuminate irrespective of the open or closed condition of the handbag, and switch means in series with said exterior terminal and electrical source for enabling the user of the handbag to turn the bulb on or off at will.

5. The electrical unit as defined in claim 1 in which said switch unit has a pair of exterior terminals, at least one of said terminals being adapted to receive either an illumination means or a theft alarm, said magnet, when in its first position, causing the illumination means to illuminate or the alarm to sound if the handbag is opened.

6. The electrical unit as defined in claim 5 in which disabling means are provided in conjunction with said alarm, so that the sounding of said alarm can be selectively prevented by the owner of the purse of handbag.

7. The electrical arrangement as defined in claim 1 in which a pressure sensitive switch is located on the bottom of the handbag, said switch being connected in series with a theft alarm and said switch unit, such that the lifting of the handbag will activate said alarm.

8. The electrical arrangement as defined in claim 7 in which switch means are provided on said switch unit for selective activation of said theft alarm by the owner of the handbag.

9. Apparatus for a handbag capable of being opened and closed comprising first and second electrically actuated devices carried by said handbag, an electrical source connected to supply electrical current to either of said devices on occasion, a control switch operatively involved with the opening and closing of said handbag, said control switch being electrically connected to normally cause a flow of current from said electrical source to bring about actuation of one or the other of said devices when said bag is opened, and a cessation of flow of such current when the bag is reclosed, a three-position switch electrically interposed to enable the selective directing of current to said first and second electrically actuated devices, said three-position switch, when in a first position, directing the flow of current to said first device when said bag is opened; when in a second position, directing the flow of current to said second device when said bag is opened; and when in the third position, effectively preventing the actuation of either of said devices.

10. The apparatus for a handbag as defined in claim 9 in which said control switch is magnetically responsive, and mounted on one side of the interior of said handbag, and a magnet supported on magnet mounting means disposed in alignment with said control switch, on the opposite side of the interior of said handbag, and having at least two positions, said magnet in a first position bringing about the flow of current through said control switch when said handbag is opened, and in a second position having no effect upon said control switch, whether the handbag is open or closed.

11. The apparatus for a handbag as defined in claim 9 in which said first electrically actuated device is an illumination means arranged to illuminate the interior of said handbag when the handbag is opened, and said second electrically actuated device is an illumination means mounted on the exterior of said bag, that can function to provide needed illumination at night.

12. The apparatus for a handbag as defined in claim 9 in which said first electrically actuated device is an illumination means arranged to illuminate the interior of said handbag when the handbag is opened, and said second electrically actuated device is an alarm means arranged to provide an audible signal if an unauthorized person opens said handbag.

13. The apparatus for a handbag as defined in claim 9 in which said first electrically actuated device is an illumination means arranged to illuminate the interior of said handbag when the handbag is opened, and said second electrically actuated device is an alarm means directly controlled by a separate electrical switch provided on the underside of said handbag, the arrangement being such that said alarm means will provide an audible signal to indicate if an unauthorized person has picked up said handbag.

14. The apparatus for a handbag as defined in claim 9 in which said first electrically actuated device is an illumination means for the interior of said handbag, and said second electrically actuated device is a pair of light bulbs connected in a circuit separate from the circuit of said first electrically actuated device, said light bulbs being disposed upon an upper exterior portion of said handbag so as to represent the eyes of an animal.

15. Apparatus for a handbag capable of being opened and closed comprising a first electrical terminal, located in the interior of said handbag, a second electrical terminal, located on the exterior of said handbag, an electrical source connected to supply power to said electrical terminals, a control switch operatively involved with the opening and closing of said handbag, said control switch being interposed between said electrical source and said first electrical terminal, said control switch being closed to supply electrical power to said first terminal when said handbag is opened, and being opened to interrupt power to said first terminal when said handbag is closed, pressure sensitive switch means mounted on the underside of said handbag, and being electrically connected between said electrical source and said second electrical terminal, such that said second terminal will be activated when said handbag is lifted, at least one of said electrical terminals being arranged to receive either an illumination means or an alarm means, and multiposition switch means interposed between said electrical source and said terminals, enabling a user to be able to selectively interrupt the flow of electrical current to either or both of said terminals.

16. The electrical arrangement as defined in claim 15 in which said control switch is magnetically responsive, and is mounted inside the handbag in substantial alignment with a magnet having at least two positions, said magnet in a first position bringing about the flow of current through said control switch when the handbag is opened, said magnet having no effect on said control switch when disposed in its second position.

17. The electrical arrangement as defined in claim 16 in which said control switch is disposed in a switch unit mounted on the opposite side of the handbag from the magnet, said switch unit also containing said multiposition switch.

18. The electrical arrangement as defined in claim 17 in which said switch unit also contains a light bulb that can be made to illuminate at such time as the purse or handbag is opened, and to turn off again as the handbag is closed.

19. The electrical arrangement as defined in claim 15 in which a pair of light bulbs are disposed in an upper part of said handbag, to resemble the eyes of an animal, and means for controlling the illumination of said bulbs, so as to provide exterior illumination for said handbag at the behest of the owner.

* * * * *